US005510052A

United States Patent [19]

McCandlish

[11] Patent Number: 5,510,052

[45] Date of Patent: Apr. 23, 1996

[54] ENZYMATIC AQUEOUS PRETREATMENT COMPOSITION FOR DISHWARE

[75] Inventor: Elizabeth McCandlish, Highland Park, N.J.

[73] Assignee: Colgate-Palmolive Co., Piscataway, N.J.

[21] Appl. No.: 296,076

[22] Filed: Aug. 25, 1994

[51] Int. Cl.[6] ..... C11D 3/386; C11D 3/60; C11D 17/00

[52] U.S. Cl. ..... 252/174.12; 252/106; 252/135; 252/156; 252/173; 252/174.17; 252/174.18; 252/174.19; 252/174.24; 252/DIG. 14

[58] Field of Search ..... 252/174.12, DIG. 12, 252/174.17, 174.18, 174.24, 106, 135, 174.19, 156, DIG. 14, 173

[56] References Cited

U.S. PATENT DOCUMENTS

| | | | |
|---|---|---|---|
| 3,819,528 | 6/1974 | Berry | 252/153 |
| 3,860,536 | 1/1975 | Landwerlen et al. | 252/551 |
| 4,090,973 | 5/1978 | Maguire, Jr. et al. | 252/174.12 |
| 4,162,987 | 7/1979 | Maguire, Jr. et al. | 252/135 |
| 4,318,818 | 3/1982 | Letton et al. | 252/174.12 |
| 4,421,664 | 12/1983 | Anderson et al. | 252/94 |
| 4,537,706 | 8/1985 | Severson, Jr. | 252/545 |
| 4,537,707 | 8/1985 | Severson, Jr. | 252/545 |
| 4,568,476 | 2/1986 | Kielman et al. | 252/95 |
| 4,620,936 | 11/1986 | Kielman et al. | 252/99 |
| 4,818,427 | 4/1989 | Altenschoepfer et al. | 252/174.21 |
| 5,035,826 | 7/1991 | Durbut et al. | 252/121 |
| 5,112,518 | 5/1992 | Klugkist et al. | 252/174.12 |
| 5,169,553 | 12/1992 | Durbut et al. | 252/99 |
| 5,173,207 | 12/1992 | Drapier et al. | 252/99 |
| 5,221,495 | 6/1993 | Cao | 252/135 |
| 5,223,179 | 6/1993 | Connor et al. | 252/548 |
| 5,269,960 | 12/1993 | Gray et al. | 252/174.12 |
| 5,281,277 | 1/1994 | Nakagawa et al. | 134/18 |

FOREIGN PATENT DOCUMENTS

| | | |
|---|---|---|
| 91/13141 | 9/1991 | WIPO . |
| 91/13142 | 9/1991 | WIPO . |

OTHER PUBLICATIONS

Hawley's Condensed Chemical Dictionary, Twelfth Edition, pp. 507, 508, 1077.

Chemical Abstracts Registry No. 103331-86-8, "Minfoam 1X", 1995.

*Primary Examiner*—Paul Lieberman
*Assistant Examiner*—Ardith Hertzog
*Attorney, Agent, or Firm*—Richard E. Nanfeldt; Robert C. Sullivan; Murray Grill

[57] ABSTRACT

The present invention relates to a pretreatment composition for dishware which comprises a thickening agent; a calcium compound; an antimicrobial preservative; a buffer system; at least one detergent active material; at least one enzyme stabilizer; at least one enzyme, an alkali metal nitrate; and water, wherein the composition at a concentration of 10 grams of said composition in one liter of an aqueous bath has a pH of about 6 to about 12.

9 Claims, No Drawings

ENZYMATIC AQUEOUS PRETREATMENT COMPOSITION FOR DISHWARE

FIELD OF THE INVENTION

The present invention relates to a pretreatment composition for dishware which comprises: a thickening agent; a calcium compound; a preservative; a buffer system; at least one detergent active material; at least one stabilizer; at least one enzyme; an alkali metal nitrate; and water, wherein the composition has a pH of about 6 to about 12.

BACKGROUND OF THE INVENTION

This invention relates to compositions in the form of liquids, sprays, gels, and pastes, which remove dried-on and cooked-on food and other difficult-to-remove soils from kitchen utensils, flatware, dishes, glassware, cookware, bakeware, cooking surfaces, and surrounding areas in a convenient, easy, timely, and mild manner.

Of the difficult-to-remove soils, the most severe is the baked and/or burned-on (especially when reheated and/or allowed to build up over time). These are very difficult to remove, without using severe methods including heat and alkali. But there is another category of soils that is also a problem especially in automatic dishwashing. Soil categories include grease, meat (including skin), dairy, fruit pie filling, carbohydrate, and starch. Soiled substrate categories include aluminum, iron, stainless steel, enamel, plastic, Corningware, Pyrex, and other glass cookware.

When people wash dishes by hand, these difficult soils are individually treated using assorted household detergents, especially light duty liquids, and lots of mechanical action. When people use a dishwasher, these tough soils require extensive pretreatment, almost to the point of completely washing the dish before putting it in the dishwasher. Pretreatment is required because of the mechanical deficiencies of the dishwashers and because people dislike having to rewash dishes because they did not come clean the first time. The use of light duty liquids for the purpose of pretreatment is inconvenient because the surfactants are very foamy and highly unsuitable for use in an automatic dishwasher. They must be rinsed off completely before putting the items in the dishwasher. It is possible to use automatic dishwasher detergent for pretreating items to be washed by a mechanical dishwasher. Deficiencies of this method revolve around the caustic and highly oxidizing nature of conventional autodish detergents which usually contain hypochlorite bleach releasing agents and alkali. Thus autodish detergents, whether dissolved or in a slurry form, are dangerous, caustic, attack surfaces and release fumes.

People use all sorts of tools and substances to pretreat their dishes. Examples include sponges, brushes, towels, steel wool, nonwoven plastic or fiber scrubber pads, copper mesh scrub pads, plastic mesh scrub pads and the like. They also use various substances including light duty liquid dish detergent (such as Dawn®, Palmolive®, Ajax®, Joy® or Lux®), ammonia, bleach, table salt, washing soda, baking soda, and commercial hard surface cleaners (for example Fantastic®, Ajax®, or 409®). The physical methods are a lot of work. The light duty liquid detergents are formulated to have high foam levels. They require complete and careful rinsing before putting any item washed with them into the dishwasher. Ammonia and bleach can be corrosive and dangerous to people and to the household items and surfaces. Table salt, washing soda and baking soda by themselves are not effective on many types of tough soil.

It is possible to use a specially formulated pretreatment composition based on surfactants, polyhydric alcohols and a thickener such as described in U.S. Pat. No. 4,818,427. This material does not take advantage of the catalytic power of enzymes and requires a relatively long soaking time, preferably at least 30 minutes.

SUMMARY OF THE INVENTION

The present invention relates to a pretreatment composition for dishware which comprises approximately by weight: 0.01 to 5.0% of a thickening agent; 0 to 1.0% of a calcium compound; 0.01 to 1.0% of a preservative; 0.1 to 5% by dry weight of a buffer system; 0 to 7.0% of at least one detergent active material; 0 to 8.0% of at least one stabilizer; 0.1 to 5.0% of a mixture of one or more enzymes; 0 to 5% of an alkali metal nitrate; and the balance being water, wherein the composition at a concentration of 10 grams of said composition in one liter of an aqueous bath has a pH of about 6 to about 12.

An objective of the invention is to reduce the work of pretreating dishes before putting them in an automatic dishwasher by eliminating the complex routines of rinsing, scraping and sorting typically undergone by the North American consumer.

Another objective is a composition to reduce the need to rewash items that have been through the dishwasher cycle but that are still dirty because they were soiled with tough soils such as starch, grease, egg, milk, and cheese.

A further objective is a composition to increase the types of items that go into the dishwasher. Often pots, pans and casseroles are washed by hand because they tend not to be well cleaned in the dishwasher.

It is an object of this invention to remove the labor of doing these by hand and enable them to be put into the machine and come out clean.

Another object of this invention is to use the waiting time between the time that the dishwasher is loaded and the time the machine is turned on in such a way as to aid in the cleaning of the dishes. Often only a few dishes are loaded into the dishwasher after each meal. Then the dishes sit, sometimes for hours and days, gradually drying out and getting harder to clean. With this invention, the dishes get easier to clean as they sit.

GENERAL DESCRIPTION

The pretreatment compositions, used to pretreat dishware for soil removal prior to cleaning the dishware in an automatic dishwasher, comprise a mixture of water, a thickening agent, at least one enzyme, a buff system, a calcium compound, a stabilizer, a preservative, an alkali metal nitrate, and optionally: at least one detergent active material, a colorant, a fragrance, and an anti-foam agent.

The thickening agents which are employed in the instant compositions at a concentration of about 0.01 to about 5.0 wt. %, more preferably 0.025 to about 2.0 wt. % and most preferably about 0.05 to about 1.5 wt. % are used to adjust the Brookfield viscosity of the composition to about 20 to about 1,000 cps, more preferably about 100 to 600 cps and most preferably about 140 to 550 cps [as measured at 10 rpm in a Brookfield DV II, #1 spindle] so that the compositions do not run off, but rather adhere to plates stacked in a non-horizontal alignment, preferably a vertical alignment. Useful thickening agents are selected from the group consisting of xanthan gum, welan gum, rhamsan gum, carboxymethyl cellulose, hydroxyalkyl cellulose (hydroxyethyl cellulose), alkyl cellulose, guar gum, locust bean gum, and polysaccharides with beta glycoside linkages and mixtures thereof. Maleic anhydride polymers, maleic anhydride-methyl vinyl ether copolymers and polyacrylic acid thickeners are also useful. In the presence of Ca ion it is preferred to have a non-chelating thickener.

The compositions include about 0 to about 1.0 wt. %, more preferably 0.1 to about 0.9 wt. %, and most preferably about 0.13 wt. % to about 0.5 wt. % of a calcium compound, wherein the calcium compound activates the enzymes. Preferred calcium compounds are inorganic calcium salts such as calcium chloride, calcium fluoride, calcium bromide, calcium sulfate, calcium nitrate, calcium carbonate and calcium bicarbonate.

The composition contains 0 to about 8.0 wt. % of an enzyme stabilizer, more preferably about 0.1 to about 6.0 wt. %, and most preferably about 0.2 to about 4.0 wt. %, wherein the enzyme stabilizer is characterized by the formula $YCO_2X$, wherein X is an alkali metal cation and Y is hydrogen or an alkyl group having 1 to about 6 carbon atoms. Especially preferred stabilizers are sodium formate, sodium acetate and sodium propionate and mixtures thereof.

An alkali metal nitrate such as lithium nitrate, sodium nitrate or potassium nitrate is employed as an auxiliary stabilizer in the compositions at a concentration level of about 0 to about 5.0 wt. %, more preferably about 0.10 to about 1.0 wt. %, and most preferably about 0.5 to about 0.9 wt. %.

The compositions include about 0.01 to about 1%, more preferably about 0.01 to about 0.5 wt. %, and most preferably about 0.02 to about 0.2 wt. % of an antimicrobial preservative which prevents attacks by microorganisms on the thickener, enzymes and other organic compounds. Suitable preservatives are Germaben II® and Germall II® sold by Sutton Labs, Ucarcide® sold by Dow Chemical and Kathon CG® sold by Rohm & Haas, other antimicrobial preservatives are selected from the group consisting of 5-chloro-2-methyl-4-isothiazolin-3-one, 2-methyl-4isothiazolin-3-one, diazolidinyl urea, methyl paraban, propyl paraban and glutaraldehyde and mixtures thereof. Formalin is less preferred since it reduces the activity of the enzymes somewhat. Other useful preservatives are benzoic acid, alkali metal salts of benzoic acid, sorbic acid and alkali salts of sorbic acid and mixtures thereof with formalin.

The compositions also include a buffer system comprising a mixture of boric acid, an alkali metal hydroxide such as lithium hydroxide, sodium hydroxide, and potassium hydroxide and an alkali metal chloride such as lithium chloride, sodium chloride and potassium chloride, wherein the concentration of the buffer system is about 0.1 to 5.0 wt. %, more preferably about 0.2 to about 2.0 wt. %. The concentration of the boric acid in the mixture is about 0.035 to about 2.0 wt. %, more preferably 0.07 to about 0.7 wt. % and the concentration of the alkali metal chloride in the mixture is about 0.035 to about 2.0 wt. %, more preferably 0.07 to about 0.7 wt. % and the concentration of the alkali metal hydroxide in the mixture is about 0.03 to about 1.0 wt. %, more preferably about 0.06 to about 0.6 wt. %. Other boron-containing systems such as boric oxide, borax, alkali metal borates are suitable, but boric acid is preferred.

Other suitable buffers can be used in place of the previously mentioned buffers such as tris buffer. Tris buffer is 2-amino-2-hydroxymethyl 1,3-propanediol also known as tris (hydroxymethyl)aminomethane and is used as a buffer in the range pH 7 to 9. Other suitable buffers are $NaHCO_3$, $NaCO_3$, and $KH_2PO_4$ in the appropriate parts of the pH range covered by this invention. Other suitable buffers are borax, $NaHPO_4$, and the so called "Good" buffers as listed in the Handbook of Biochemistry, Herbert A. Sobe, ed., CRC Press, Cleveland, Ohio 1970, p. 238. The buffers should be made up in the range of pH about 6 to 12, preferably in the range of 7 to 11.

The composition includes a detergent active material which can be a nonionic surfactant or a mixture of a nonionic surfactant and an anionic surfactant in a weight ratio of about 2/1 to about 100/1, but a ratio of 3/1 or higher is preferred. Combinations of two or more nonionics and two or more anionics can also be used.

The concentration of the detergent active material in the composition is about 0 to about 7.0 wt. %, more preferably about 0.05 to about 4.0 wt. %, and most preferably about 0.1 to about 1.5 wt. %.

The liquid nonionic surfactants that can be used in the present detergent compositions are well known. A wide variety of these surfactants can be used.

The nonionic synthetic organic detergents are generally described as ethoxylated, propoxylated fatty alcohols which are low-foaming surfactants and are possibly capped. The molecules are characterized by the presence of an organic hydrophobic group and an organic hydrophilic group and are typically produced by the condensation of an organic aliphatic or alkyl aromatic hydrophobic compound with ethylene oxide and/or propylene oxide. Practically any hydrophobic compound having a carboxy, hydroxy, amido or amino group with a free hydrogen attached to the nitrogen can be condensed with ethylene oxide or with the polyhydration product thereof, polyethylene glycol, to form a nonionic detergent. The length of the hydrophilic or polyoxy ethylene chain can be readily adjusted to achieve the desired balance between the hydrophobic and hydrophilic groups. Typical suitable nonionic surfactants are those disclosed in U.S. Pat. Nos. 4,316,812 and 3,630,929.

A preferred class of the nonionic detergent employed is the poly-lower alkoxylated higher alkanol wherein the alkanol is of 9 to 18 carbon atoms and wherein the number of moles of lower alkylene oxide (of 2 or 3 carbon atoms) is from 3 to 15. Of such materials it is preferred to employ those wherein the higher alkanol is a high fatty alcohol of 9 to 11 or 12 to 15 carbon atoms.

Useful nonionics are represented by the low foam Plurafac series from BASF Chemical Company which are the reaction product of a higher linear alcohol and a mixture of ethylene and propylene oxides, containing a mixed chain of ethylene oxide and propylene oxide, terminated by a hydroxyl group.

Of such materials it is preferred to employ those wherein the higher alkanol is a high fatty acid of 12 to 15 carbon atoms and which contain 3 to 15 alkoxy groups. Examples of such surfactants are $c_{21-15}$6EO 3PO, $C_{13-15}$4EO, 7PO, $C_{12-15}$10EO, 5 PO. Similar surfactants are members of the Plurafac series from BASF. Also useful are Plurafac LP 132 and Plurafac LP 231 and Plurafac RA30. Lutensol SC9713 and Synperionic LP/D25 are also useful.

An especially preferred type of surfactant is a very high molecular weight surfactant such as Tergitol MDS 42 and Tergitol MDS 32. These surfactants have molecular weights of around 6000. They are very low foamers and are particularly suited to automatic dishwashing. It is estimated by calculation that if the hydrophobe is $C_{13}H_{27}$, then Tergitol MDS 42 would have up to 132 ethylene oxide residues and up to 93 propylene oxide residues if all the rest of the weight were taken up by one or the other exclusively. Of course, there is expected to be a balance between the ethylene oxide and propylene oxide fractions. Other useful surfactants are Tergitol Minfoam 1 x and Tergitol Minfoam 2x. These surfactants have good wetting properties, plus the low foam that is important for effective cleaning in the automatic dishwasher.

Other useful surfactants are Neodol 25-7 and Neodol 23-6.5, which products are made by Shell Chemical Company, Inc. The latter is a condensation product of a mixture of higher fatty alcohols averaging about 12 to 13 carbon atoms and the number of ethylene oxide groups present averages about 6.5. The higher alcohols are primary alkanols. Other examples of such detergents include Tergitol 15-S-7 and Tergitol 15-S-9 (registered trademarks), both of which are linear secondary alcohol ethoxylates made by Union Carbide Corp. The former is mixed ethoxylation product of 11 to 15 carbon atoms linear secondary alkanol with seven moles of ethylene oxide and the latter is a similar product but with nine moles of ethylene oxide being reacted.

Also useful in the present compositions as a component of the nonionic detergent are higher molecular weight nonionics, such as Neodol 45-11, which are similar ethylene oxide condensation products of higher fatty alcohols, with the higher fatty alcohol being of 14 to 15 carbon atoms and the number of ethylene oxide groups per mole being about 11. Such products are also made by Shell Chemical Company.

Another useful class of surfactants is the anionics. They are more hostile to the enzymes than the nonionics, but they impart useful wetting and detergency properties to the composition. Often food soils are dried out, (especially when baked on or not washed immediately) hydrophobic as in baked egg, or microporous as in potato and cooked starch. In order for the enzymes to work well on these soils, they have to thoroughly wet the soils. For this reason it is useful to add a wetting agent. The anionics are acceptable to the enzymes as long as the anionic/nonionic ratio is less than about ⅓. It is important to limit the concentration of the anionics in the formula not only to maintain the stability of the enzymes, but also to limit the foam generation in the machine.

Useful anionics include those in the table below:

| Name | Hydrophobe | Ethylene Oxide Units | Preferred |
|---|---|---|---|
| alkylbenzene sulfonates | $C_9$–$C_{15}$ | none | |
| secondary n-alkane sulfonates (paraffin sulfonates) | $C_8$–$C_{24}$ | none | $C_{12}$–$C_{18}$ |
| soluble esters of alpha sulfonated fatty acids | $C_6$–$C_{20}$ | none | |
| sulfosuccinate esters | $C_6$–$C_{20}$ | none | |
| alkyl glyceryl ether sulfonates | $C_6$–$C_{18}$ | | |
| alkylphenol ether | $C_1$–$C_{14}$ | 1–4 | |
| alkyl sulfates | $C_8$–$C_{18}$ | none | |
| alkyl ethoxy sulfates | $C_{10}$–$C_{20}$ | 1–10 | 1–3 EO, $C_{11}$–$C_{13}$ |

The preferred surfactants are alkyl ethoxy sulfates c10–C18 with 1–4 ethylene oxide groups, preferably 1–2 ethylene oxide groups, and alpha sulfated and sulfonated fatty acids such as R—CH—(SO3—Na+) COO R' wherein R has about 1 to 8 carbon atoms and R' has 1 to about 8 carbon atoms.

Another group of good wetting agents is block copolymers of ethylene oxide and propylene oxide, especially materials of high molecular weight with low ethylene oxide content. Examples of such materials are the Pluronics from BASF, especially Pluronic L101, L81, D103, 25R1, 31R1, 31R2, 25R2 as well as the Tetronic and the Tetronic R series. Other useful surfactants include Triton CF 21, CF 10 and the Tergitol series, especially Tergitol Minfoam 1X, Tergitol Minfoam 2X, which are good wetting agents and also relatively low foamers.

The alkylpolysaccharide surfactants are also useful alone or in conjunction with the aforementioned surfactants. Alkypolysaccharides have a hydrophobic group containing from about 8 to about 20 carbon atoms, preferably from about 10 to about 16 carbon atoms, most preferably from 12 to 14 carbon atoms, and polysaccharide hydrophilic group containing from about 1.5 to about 10, preferably from 1.5 to 4, and most preferably from 1.6 to 2.7 saccharide units (e.g., galactoside, glucoside, fructoside, glucosyl, fructosyl, and/or galactosyl units). Mixtures of saccharide moieties may be used in the alkylpolysaccharide surfactants. The number x indicates the number of saccharide units in a particular alkylpolysaccharide surfactant. For a particular alkylpolysaccharide molecule, x can only assume integral values. Any physical sample can be characterized by the average value of x and this average value can assume non-integral values. In this specification the values of x are to be understood to be average values. The hydrophobic group (R) can be attached at the 2-,3-, or 4- positions rather than at the 1- position, (thus giving e.g. a glucosyl or galactosyl as opposed to a glucoside or galactoside). However, attachment through the 1-position, i.e., glucosides, galactosides, fructosides, etc., is preferred. In the preferred product the additional saccharide units are predominately attached to the previous saccharide unit's 2-position. Attachment through the 3-, 4-, and 6- positions can also occur. Optionally and less desirably they can be a polyalkoxide chain joining the hydrophobic moiety (R) and the polysaccharide chain. The preferred alkoxide moiety is ethoxide.

Typical hydrophobic groups include alkyl groups, either saturated or unsaturated, branched or unbranched containing from about 8 to about 20, preferably from about 10 to about 16 carbon atoms. Preferably, the alkyl group is a straight chain saturated alkyl group. The alkyl group can contain up to 3 hydroxy groups and/or the polyalkoxide chain can contain up to about 30, preferably less than 10, most preferably 0, alkoxide moieties.

Suitable alkyl polysaccharides are decyl, dodecyl, tetradecyl, pentadecyl, hexadecyl, and octadecyl, di-, tri-, tetra-, penta- and hexaglucosides, galactosides, lactosides, fructosides, fructosyls, lactosyls, glucosyls and/pr galactosyls and mixtures thereof.

The alkyl monosaccharides are relatively less soluble in water than the higher alkylpolysaccharides. When used in admixture with alkylpolysaccharides, the alkylmonosaccharides are solubilized to some extent. The use of alkylmonosaccharides in admixture with alkylpolysaccharides is a preferred mode of carrying out the invention. Suitable mixtures include coconut alkyl, di-, tri-, tetra-, and pentaglucosides and tallow alkyl tetra-, penta-, and hexaglucosides.

The preferred alkylpolysaccharides are alkylpolyglucosides having the formula:

$$R_2O(C_nH_{2n}O)_t(Z)_x$$

wherein Z is derived from glucose, R is a hydrophobic group selected from the group consisting of alkyl, alkylphenyl, hydroxyalkylphenyl, and mixtures thereof in which said alkyl groups contain from about 10 to about 18, preferably from 12 to 14 carbon atoms; n is 2 or 3 preferably 2, r is from 0 to about 10, preferably 0; and x is from 1.5 to about 8, preferably from 1.5 to 4, most preferably from 1.6 to 2.7.

The amount of unreacted alcohol (the free fatty alcohol content) in the desired alkylpolysaccharide surfactant is preferably less than about 2%, more preferably less than about 0.5% by weight of the total of the alkylpolysaccharide. For some uses it is desirable to have the alkylmonosaccharide content less than about 10%.

The used herein, "alkylpolysaccharide surfactant" is intended to represent both the preferred glucose and galactose derived surfactants and the less preferred alkylpolysaccharide surfactants. Throughout this specification, "alkylpolyglucoside" is used to include alky-polyglycosides because the stereo chemistry of the saccharide moiety is changed during the preparation reaction.

Excluded from the instant compositions are detergent builders such as phosphate builders and nonphosphate inorganic or organic builders excluding any present in the buffer system such as an alkali metal halide or an alkali metal borate. If detergent builders were used in the instant compositions, the user would have rinsing problems due to deposits of the detergent builder left on the surface being cleaned. Additionally, excluded from the instant compositions are 1,3 propanediol, aliphatic glycols such as polyethylene glycol, diethylene glycol, ethylene glycol and triethylene glycol and aliphatic alcohols such as ethanol which would cause a thinning of the thickened solution thereby preventing the instant thickened composition from obtaining the indicated and required viscosities. Additionally, $C_8$–$C_{22}$ fatty acids or metal salts of the fatty acid are excluded from the instant composition because the fatty acids or metal salts of the fatty acid could cause excessive foaming as well as leaving deposits on the surface being cleaned thereby causing further rinsing problems for the user.

The composition contains at least one enzyme at a concentration of about 0.1 to about 5.0 wt. percent, more preferably about. 1 to about 4.5 weight % and most preferably, about 0.2 to about 4.0 weight %.

A wide variety of enzymes can be used, but proteases and amylases are preferred. The protease can be from an animal, a vegetable or a microorganism. Bromelain, derived from plants of the family Bromaliaceae is useful with or without amino acid cysetine. Particularly preferred are subtilisin-type proteases obtained from *B. subtills* and *B. lichenformis*. Other useful proteases are from *B. alcalophylus*. Suitable commercial available proteases are Maxatase and Maxacal protease from International Bio-Synthetics, Alcalase, Savinase and Esperase from NOVO Industries A/S, Milezyme PAL from Miles Labs and Proact DU 1000 from Kodak. A combination of two or more proteases would also be useful in this invention.

Amylases useful in this invention are available commercially as Maxamyl and Rapidase from International Bio Synethetics, and Alcamyl and Termamyl from NOVO Industries.

Of the available enzymes, the ones that are preferred are the ones with appreciable activity at lower temperatures, such as Maxamyl and Maxatase.

Combinations of two or more enzymes are useful in this invention. When an amylase enzyme and an alkaline protease enzyme are both used in the composition, the ratio of amylase enzyme to said protease enzyme is about 100 to 1 to about 1 to 10. The composition can also optionally contain 0.1 to 5.0 wt. % of a lipase enzyme.

The compositions of the instant invention are prepared by first forming at about room temperature a slurry of water, the thickener and the preservative. If a thickener is not present, then a slurry is formed only of the perservative and water.

A salt concentrate is made by mixing water, the calcium compound, sodium nitrate, enzyme stabilizer, buffer system and any other ionic components at room temperature with stirring.

The dispersion of thickener and antimicrobial preservative, the salt concentrate and water are mixed together with stirring at room temperature. The remaining ingredients, such as surfactant, are added with stirring at room temperature. Last, the enzyme or mixture of enzymes is added with stirring at room temperature.

A typical pretreatment composition for the pretreatment of dishware prior to its cleaning in an automatic dishwasher comprise, approximately by weight:

(a) 0.05 to 2.0% of a thickening agent;

(b) 0.1 to 0.9% of a calcium compound;

(c) 0.01 to 1.0% of an antimicrobial preservative;

(d) 0.1 to 5.0% of a buffer system comprising a mixture of boric acid, an alkali metal halide and an alkali metal hydroxide;

(e) 0.05 to 4.0% of at least one detergent active material;

(f) 0.2 to 4.0% of at least one enzyme stabilizer;

(g) 0.1 to 5.0% of at least one enzyme;

(h) 0.1 to 1.0% of an alkali metal nitrate; and (i) balance being water, said composition has a pH of about 6 to about 12 at a concentration of 10 grams of said composition in one liter of an aqueous bath, wherein the composition has a Brookfield viscosity at room temperature (25° C.) of about 100 to 600 cps at a 10 rpms using a #1 spindle and the composition does not contain phosphate builders, nonphosphate builders excluding any nonphosphate builders present in the buffer system, organic builders or fatty acids or metal salts of fatty acids and the compositions are optionally clear having at least 95% light transmission.

DETAILED DESCRIPTION OF THE PREFERRED EMBODIMENTS

The following example will serve to illustrate the present invention without being deemed limitative thereof. Parts and percents are by weight unless otherwise indicated.

EXAMPLE I

The following formulas were prepared according to the following method.

A suitable preservative was dispersed in about 7.5 to about 8 parts of water using a series 2000 model 84 Dispersator at room temperature (25° C.) to form a slurry. When a thickener is present it can be dispersed with the perservative in the about 7.5 to about 8 parts of water using a series 2000 model 84 Dispersator at room temperature to form a thickened slurry. A more dilute thickener slurry can be made by using up to about 40 to 42 parts of water. If the particular thickener chosen is hard to disperse, then the higher amount of water is better. This made it easier to get a uniformly thickened product, without fish eyes.

A salt concentrate was made by adding the calcium compound, sodium nitrate, sodium formate, the buffer system and any other ionic components to about 40 to about 50 parts of water. The mixture was stirred on a magnetic stirrer at room temperature until the salts dissolved, about 10 minutes.

The thickened slurry and the salt concentrate and any remaining water from the formula were added together as follows: the remaining water from the formula was added to the thickened slurry. Then the buffer and salts were added. The thickened slurry should be as dilute as possible before the salts are added to avoid the formation of fish eyes. The composition was stirred on a magnetic stirrer for 15–20 minutes at room temperature.

The remaining ingredients were added to the thickened slurry plus salt mixture. The enzyme was added last to the composition which was stirred on a magnetic stirrer for 10 minutes at room temperature.

| | A Control | B | C | D | E |
|---|---|---|---|---|---|
| KELZAN | | | 0.1 | | |
| CMC 12M31P | | 0.5 | | 0.5 | |
| GANTREZ | | | | 0.5 | |
| GERMABEN | | | 0.0405 | | |
| WATER | 8.1 | 7.6 | 7.9595 | 7.6 | 7.6 |
| $CaCL_2.2H_2O$ | 0.13 | 0.13 | 0.13 | 0.13 | 0.13 |
| $NaNO_3$ | 0.5 | 0.5 | 0.5 | 0.5 | 0.5 |
| NaFORMATE | 3 | 3 | 3 | 3 | 3 |
| KCL | 0.373 | 0.373 | 0.373 | 0.373 | 0.373 |
| $H_3BO_3$ | 0.309 | 0.309 | 0.309 | 0.309 | 0.309 |
| NaOH(50%) | 0.202 | 0.202 | 0.202 | 0.202 | 0.202 |
| WATER | 45.486 | 45.486 | 45.486 | 45.486 | 45.486 |
| TERGITOL | | 0.1 | 0.1 | | |
| MDS42 | | | | | |
| MINFOAM 1X | | | | | 0.1 |
| MAXATASE MLX 32 | 0.75 | 0.75 | 0.75 | 0.75 | 0.75 |
| WATER | 41.15 | 41.55 | 41.1905 | 41.65 | 41.55 |
| pH | 8.92 | 8.9 | 8.92 | (2) | (2) |
| Visc., cps, approx.[1] | 5 | 23 | 38 | 30–60 | (2) |
| OAT CLEANING | 30/90 | 50/90 | 55/90 | 50/90 | (2) |
| EGG CLEANING | 16/87 | 9/83 | 21/81 | 8/74 | (2) |

[1]Measure the viscosity with a Brookfield viscometer at 10 rpm in a model DVII using a #1 spindle.
(2) not measured

EXAMPLE II

The following formulas (F–J) were prepared according to the procedures of Example I.

| | F | G | H | I | J |
|---|---|---|---|---|---|
| KELZAN | 0.1 | 0.1 | 0.1 | 0.1 | 0.1 |
| GERMABEN | | | 0.0405 | | |
| UCARCIDE | | | | 0.0405 | |
| KATHON CG | | 0.00546 | | | |
| FORMALIN | | | | | 0.016 |
| WATER | 8 | 7.99454 | 7.9595 | 7.9595 | 8 |
| $CaCL_2.2H_2O$ | 0.13 | 0.13 | 0.13 | 0.13 | 0.13 |
| $NaNO_3$ | 0.5 | 5.5 | 0.5 | 0.5 | 0.5 |
| NaFORMATE | 3 | 3 | 3 | 3 | 3 |
| KCL | 0.373 | 0.373 | 0.373 | 0.373 | 0.373 |
| $H_3BO_3$ | 0.309 | 0.309 | 0.309 | 0.309 | 0.309 |
| NaOH(50%) | 0.202 | 0.202 | 0.202 | 0.202 | 0.202 |
| WATER | 45.486 | 45.486 | 45.486 | 45.486 | 45.486 |
| MINFOAM 1X | 0.1 | 0.1 | 0.1 | 0.1 | |
| MAXATASE MLX 320 | 0.75 | 0.75 | 0.75 | 0.75 | 0.75 |
| WATER | 41.05 | 41.05 | 41.05 | 41.05 | 41.15 |
| pH approx. | 9 | 9 | 9 | 9 | (2) |
| Visc., cps, approx.[1] | 40 | 40 | 40 | 40 | (2) |
| OAT CLEANING | 56/95 | 60/95 | 38/87 | 55/92 | (2) |
| EGG CLEANING | 29/73 | 30/82 | 33/86 | 32/88 | (2) |
| Time, min. | 15 | 15 | 15 | 15 | (2) |
| Temp., °C. | 22–23 | 22–23 | 22–23 | 22–23 | (2) |

[1]Brookfield viscosity, See note to Example II.
(2) not measured

EXAMPLE III

The following formulas (K–O) were prepared according to the procedures of Example I.

| | K | L | M | N | O |
|---|---|---|---|---|---|
| KELZAN | | 0.1 | 0.1 | 0.1 | 0.1 |
| GERMABEN | | 0.0405 | 0.49 | 0.0405 | 0.49 |
| WATER | 8 | 7.9595 | 7.51 | 7.9595 | 7.51 |
| $CaCL_2.2H_2O$ | 0.13 | 0.13 | 0.13 | 0.13 | 0.13 |
| $NaNO_3$ | 0.5 | 0.5 | 0.5 | 0.5 | 0.5 |
| NaFORMATE | 3 | 3 | 3 | 3 | 3 |
| KCL | 0.373 | 0.373 | 0.373 | 0.373 | 0.373 |
| $H_3BO_3$ | 0.309 | 0.309 | 0.309 | 0.309 | 0.309 |
| NaOH(50%) | 0.202 | 0.202 | 0.202 | 0.202 | 0.202 |
| WATER | 45.486 | 45.486 | 45.486 | 45.486 | 45.486 |
| TERGITOL | 0 | 0.1 | 0.1 | 0 | 0 |
| MDS42 | | | | | |
| MINFOAM 1X | 0 | 0 | 0 | 0.1 | 0.1 |
| MAXATASE MLX 32 | 0.75 | 0.75 | 0.75 | 0.75 | 0.75 |
| WATER | 41.15 | 41.05 | 41.05 | 41.05 | 41.05 |
| pH | 9 | 9 | 9 | 9 | 9 |
| Visc., cps, approx.[1] | 40 | 40 | 40 | 40 | 40 |
| OAT CLEANING | 44/79 | 43/90 | 47/88 | 47/77 | 42/77 |
| EGG CLEANING | 11/86 | 10/84 | 9/90 | 6/85 | 3/83 |

[1]Brookfield viscosity, See note to Example II.

EXAMPLE IV

The following formulas (P–Q) were prepared according to the procedures of Example I.

| | P | Q |
|---|---|---|
| KELZAN | 0.1 | 0.1 |
| GERMABEN | 0.0405 | 0.0405 |
| WATER | 7.96 | 7.96 |
| KCL | 0.3392 | 0.3392 |
| $H_3BO_3$ | 0.2816 | 0.2816 |
| NaOH(50%) | 0.0357 | 0.0357 |
| WATER | 49.3435 | 49.3435 |
| TERGITOL MDS42 | 1 | 1 |
| NEODOL25-3S | 0.03 | 0.3 |
| MAXATASE MLX 320K | 0.75 | 0.75 |
| WATER | 40.1195 | 39.8495 |
| pH, approx. | | 8 |
| Visc., cps | 30–60 | 30–60 |
| Black oatmeal, Rd[1] | 51 | 46 |
| $CaCl_2$ egg | 33 | 48 |

[1]Time, 10 min, temp 24° C., plates flooded, no applicator. The whole plate was treated. The degree of oatmeal cleaning was determined on a large area view reflectometer. The Rd of an unwashed plate is approximately zero. The Rd of a completely clean plate is approximately 60.

| | AA | BB |
|---|---|---|
| RHAMSAN | 0.0993 | 0.0993 |
| GERMABEN | 0.0402 | 0.0402 |
| WATER | 7.9001 | 7.9001 |
| $CaCL_2.2H_2O$ | 0.1290 | 0.1290 |
| $NaNO_3$ | 0.4963 | 0.4963 |
| NAFORMATE | 2.9776 | 2.9776 |
| KCL | 0.3702 | 0.3702 |
| $H_3BO_3$ | 0.3067 | 0.3067 |
| NaOH(50%) | 0.2005 | 0.2005 |
| WATER | 45.1465 | 45.1465 |
| TERGITOL MDS42 | 0.0993 | 0.0993 |
| NEODOL 25-3S | 0.0318 | 0.0318 |
| MAXATASE MLX 320K | 1.4888 | 1.4888 |
| WATER | 40.7138 | 39.8200 |
| pH | 9.05 | 9.12 |
| Visc., cps | 170 | 167 |
| Black oatmeal cleaning, Rd[1] | 45 | 51 |
| $CaCl_2$ egg | 6 | 5 |

[1]Time, 10 min, temp 24° C., plates flooded, no applicator. The whole plate was treated. The degree of oatmeal cleaning was determined on a large area view reflectometer. The Rd of an unwashed plate is approximately zero. The Rd of a completely clean plate is approximately 60.

EXAMPLE V

The following formulas (CC–DD) were prepared according to the procedures of Example I.

| | CC | DD |
|---|---|---|
| RHAMSAN | 0.0993 | 0.0993 |
| GERMABEN | 0.0402 | 0.0402 |
| WATER | 7.9001 | 7.9001 |
| $CaCL_2.2H_2O$ | 0.1290 | 0.1290 |
| $NaNO_3$ | 0.4963 | 0.4963 |
| NAFORMATE | 2.9776 | 2.9776 |
| KCL | 0.3702 | 0.3702 |
| $H_3BO_3$ | 0.3067 | 0.3067 |
| NaOH(50%) | 0.2005 | 0.2005 |
| WATER | 45.1465 | 45.1465 |
| TERGITOL MDS42 | 0.0993 | 0.9930 |
| NEODOL25-3S | 0.2978 | 0.2978 |
| MAXATASE MLX 320K | 1.4888 | 1.4888 |
| WATER | 40.4478 | 39.5540 |
| pH | 9.1 | 9.03 |
| Visc., cps | 167 | 170 |

-continued

| | CC | DD |
|---|---|---|
| Black oatmeal cleaning, Rd[1] | 52 | 50 |
| $CaCl_2$ egg | 3 | 3 |

The test procedure used to measure cleaning in Examples 1–6 is described as follows:

Twenty-four grams of Quaker Quick Oats, 2 g of Cabot pigment grade carbon black (Sterling R, V647) and 400 g of tap water were boiled together with stirring until the total weight of the mixture was 260 g. The oatmeal was cooked until it reached 120°–130° F. and blended in an Osterizer blender for 30 seconds on "low grind". Three grams of this mixture was spread on each plate in a circle of 11 cm in diameter. The plates were baked for two hours at 80° C. and then carbon black to make it visible on the plate. $CaCl_2$ egg soil was prepared by mixing equal parts of egg yolk and 2.5M $CaCl_2$ in a small beaker, using a stirring bar. Egg soil was painted on the plate in the shape of a cross with an area of 40 sq. cm. The plates were stored in a constant humidity incubator (50%+2% RH) overnight before being used. After washing, the egg plates were stained with a dilute solution of Eosin Y. This dye preferentially adhered to certain food soils, rather than the china plates. It was used as a coloring agent so the remaining egg could be seen easily.

The plates were treated with test solutions. The test solutions were applied with a variety of applicators. The plates were then incubated vertically or horizontally at room temperature for 15 min. Formulations were incubated horizontally. The plates were put in an automatic dishwasher and washed in the presence of 40 g of a mixture of 4 parts margarine to 1 part powdered milk and 10 g of whole milk, using water of 120F. and 300 ppm hardness. At the beginning of the main wash, 80 g of a commercial liquid automatic dishwasher product was added.

In the Examples the plates were treated on only one half. When the plates were scored, the treated half was compared to the untreated half. For black oatmeal, in Examples 1–4 the plates were rated by eye as to percent of the surface area still dirty. The higher numbers mean dirtier plates. The first number in the table is the percent of area still dirty on the treated side, separated by a slash from the percent still dirty of the untreated area. The egg plates were rated by counting the number of ¼×¼ in. squares still dirty on the treated and untreated sides of the plate. The results are reported as (percent of treated area still dirty)/(percent of untreated area still dirty). Higher numbers mean dirtier plates.

In Examples 4 and 5, the entire plate was treated. The method for scoring the egg plates was the same except that only one score was given because the whole plate was treated. The oat plates were scored in a completely different way. Since the oatmeal contained carbon black the oatmeal could be easily detected by large area view reflectometer. The reflectometer reading was roughly proportional to the log of the weight of the soil remaining on the plate. The highest possible reflectometer reading is Rd=60 for a clean plate. The plates were slightly off white so higher readings were not expected. The Rd of a plate that was washed in a dishwasher, but not pretreated with present invention, was about 20. The Rd of a completely unwashed black oatmeal plate was approximately zero. The dirtier plates have lower numbers and this was just the opposite from Examples 1–3.

The viscosities as measured in the Examples were Brookfield viscosities measured at room temperature using a #1 spindle at 10 rpms.

The pH was determined by measuring an aqueous solution of the composition at a concentration 10 grams of the composition per liter of water.

EXAMPLE VI

The following samples were prepared:

| | A | B | C |
|---|---|---|---|
| Component | | | |
| Xanthan gum | 0.10 | 0.10 | 0.10 |
| preservative (2) | 0.005 | 0.005 | 0.005 |
| $CaCL_2.2H_2O$ | 0.13 | 0.13 | 0.13 |
| $NaNO_3$ | 0.50 | 0.50 | 0.50 |
| NAFORMATE | 3.00 | 3.00 | 3.00 |
| H2BO3 | 0.31 | 0.31 | 0.31 |
| NaOH(50%) | 0.17 | 0.17 | 0.17 |
| KCl | 0.37 | 0.37 | 0.37 |
| Tergitol Minfoam 1x | 0.10 | 0.10 | 0.10 |
| Stearic Acid | | 5.00 | 0.00 |
| NaTPP | | | 5.00 |
| Alcamyl enzyme | 0.80 | 0.80 | 0.80 |
| TOTAL WATER | 94.51 | 89.52 | 89.52 |
| egg score for treated half of the plate, squares with | 7 | 9 | 21 |
| oat score for the treated half of the plate, Rd | 50.8 | 47.9 | 44.6 |
| Appearance | optically clear | lumps in composition | cloudy |
| pH | 9 | | |
| viscosity cps (1) | 29 | | |

(1)Brookfield LV, RT, #18 spindle, 12 rpms
(2)Mixture of 5-chloro-2methyl-4-isothiazoline-3-one and 2-methyl-4-isothiazolin-3-one The instant compositions (Sample A) are homogenous and optically clear. The addition of stearic acid (Sample B) causes the composition to have lumps therein and the addition of NaTTP (Sample C) forms a composition that is not optically clear. The 10 lower the egg score the better cleaning and the higher the score for oat cleaning the better the cleaning. Adding either stearic acid or sodium tripolyphosphate (NaTPP) has an adverse effect on oat or egg cleaning. The foregoing detailed description of the invention is given by way of illustration only. Thus, variations may be made therein without departing from the scope and spirit of the invention.

What is claimed is:

1. A pretreatment composition for dishware which comprises approximately by weight:

(a) 0.05 to 2.0% of a thickening agent selected from the group consisting of xanthan gum, welan gum, rhamsan gum, guar gum, carboxymethyl cellulose, hydroxyalkyl cellulose, alkyl cellulose, polysaccharides with beta glycoside linkages, locust bean gum and maleic anhydride-methyl ether copolymers;

(b) 0.1 to 0–9% of a calcium compound;

(c) 0.01 to 1.0% of an antimicrobial preservative;

(d) 0.1 to 5.0% of a buffer system comprising a mixture of boric acid, an alkali metal chloride and an alkali metal hydroxide;

(e) 0.05 to 4.0% of at least one surfactant;

(f) 0.2 to 4.0% of at least one enzyme stabilizer wherein said enzyme stabilizer has the formula $YCO_2X$, wherein Y is hydrogen or an alkyl group having about 1 to about 6 carbon atoms and X is an alkali metal cation;

(g) 0.1 to 5.0% of at least one enzyme being selected from the group consisting of an amylase enzyme, alkaline protease enzyme or a mixture of said amylase enzyme and said alkaline protease enzyme, if said amylase enzyme and said alkaline protease enzyme are both present, then a weight ratio of said amylase enzyme to said protease enzyme being about 100 to 1 to about 1 to 10;

(h) 0.1 to 1.0% of an alkali metal nitrate; and (i) balance being water, said composition at a concentration of 10 grams of said composition in one liter of an aqueous bath having a pH of about 6 to about 12, wherein the composition has a Brookfield viscosity at room temperature of about 100 to 600 cps at 10 rpms using a #1 spindle and the composition does not contain phosphate builders, nonphosphate builders excluding any present in said buffer system, organic builders, aliphatic glycols and aliphatic mono alcohols, or fatty acids or metal salts of fatty acids excluding any present in said antimicrobial perservative.

2. The composition of Claim 1, wherein said antimicrobial preservative is selected from the group consisting of 5-chloro-2-methyl-4-isothiazolin-3-one, 2-methyl-4-isothiazolin-3-one, methyl paraben, propyl paraben, diazolidinyl urea, glutaraldehyde, formalin, benzoic acid, alkali metal salts of benzoic acid, sorbic acid and alkali salts of sorbic acid and mixtures thereof.

3. The composition of Claim 1, wherein said calcium compound is an inorganic calcium salt;

4. The composition of Claim 1, wherein said buffer system comprises a mixture of an alkali metal hydroxide, an alkali metal chloride and boric acid at a concentration sufficient to adjust the pH of the composition to about 6 to about 10.

5. The composition of Claim 4, wherein said alkali metal chloride is selected from the group consisting of lithium chloride, sodium chloride and potassium chloride.

6. The composition of Claim 5, wherein said alkali metal hydroxide is selected from the group consisting of lithium hydroxide, sodium hydroxide and potassium hydroxide.

7. The composition of Claim 1, wherein said surfactant comprises a mixture of a nonionic surfactant and an anionic surfactant, a weight ratio of said nonionic surfactant to said anionic surfactant being about 100/1 to about 2/1.

8. The composition of Claim 1 further including about 0.1 to about 5 wt. % of a lipase enzyme.

9. The composition of Claim 1, wherein said alkali metal hydroxide is selected from the group consisting of lithium hydroxide, sodium hydroxide and potassium hydroxide.

* * * * *